US012240671B2

(12) United States Patent
Shirai

(10) Patent No.: US 12,240,671 B2
(45) Date of Patent: Mar. 4, 2025

(54) PACKING MATERIAL AND PACKED PRODUCT

(71) Applicant: HOWA SANGYO CO., LTD., Funabashi (JP)

(72) Inventor: Naoto Shirai, Chiba (JP)

(73) Assignee: HOWA SANGYO CO., LTD., Funabashi (JP)

( * ) Notice: Subject to any disclaimer, the term of this patent is extended or adjusted under 35 U.S.C. 154(b) by 114 days.

(21) Appl. No.: 17/680,510

(22) Filed: Feb. 25, 2022

(65) Prior Publication Data

US 2023/0049893 A1 Feb. 16, 2023

(30) Foreign Application Priority Data

Aug. 10, 2021 (JP) ..... 2021-130814

(51) Int. Cl.

| | |
|---|---|
| ***B65D 65/08*** | (2006.01) |
| ***B65D 65/10*** | (2006.01) |
| ***B65D 65/24*** | (2006.01) |
| ***B65D 75/58*** | (2006.01) |

(52) U.S. Cl.

CPC ..... *B65D 65/24* (2013.01); *B65D 65/08* (2013.01); *B65D 65/10* (2013.01); *B65D 75/5838* (2013.01)

(58) Field of Classification Search

CPC ..... B65D 65/00; B65D 65/02; B65D 65/08; B65D 65/22; B65D 65/24; B65D 75/5838; B65D 75/5855; B65D 2401/00; B65D 2401/10; B65D 2401/60; B65D 75/5844; B65D 75/12; B65D 75/5894; B65B 61/184

USPC ..... 229/87.5, 87.08; 383/205

See application file for complete search history.

(56) References Cited

U.S. PATENT DOCUMENTS

| | | | | |
|---|---|---|---|---|
| 3,261,538 | A * | 7/1966 | Jones et al. | B65D 75/5838 229/87.08 |
| 3,396,900 | A * | 8/1968 | Lucas | B65D 75/5838 383/205 |
| 3,761,013 | A * | 9/1973 | Schuster | A61B 50/30 206/439 |
| 4,638,911 | A * | 1/1987 | Prohaska | B65D 75/66 206/484 |
| 4,723,301 | A * | 2/1988 | Chang | B65D 75/5838 383/211 |
| 4,739,879 | A * | 4/1988 | Nakamura | B65B 61/184 383/207 |
| 5,620,095 | A * | 4/1997 | Delmore et al. | B65D 75/58 383/201 |
| D394,605 | S * | 5/1998 | Skiba et al. | D9/709 |

(Continued)

FOREIGN PATENT DOCUMENTS

| | | | | |
|---|---|---|---|---|
| DE | 4007649 | C1 | 9/1991 | |
| EP | 1598284 | A1 * | 11/2005 | B65D 83/0805 |

(Continued)

*Primary Examiner* — Stephen F. Gerrity

(74) *Attorney, Agent, or Firm* — The Webb Law Firm

(57) ABSTRACT

Provided is a packing material for packing a packing object, and includes: a sheet having an opening area that is surrounded by a cut line; and a label fixed to the opening area. The opening area is configured to be separable from the sheet by breaking the cut line by pulling the label in a direction in which the label is separated from the sheet.

4 Claims, 4 Drawing Sheets

(56) References Cited

U.S. PATENT DOCUMENTS

| | | | | | |
|---|---|---|---|---|---|
| 6,060,095 | A * | 5/2000 | Scrimager | B65D 75/5833 | 426/118 |
| 6,113,271 | A * | 9/2000 | Scott et al. | B65D 75/5838 | 383/203 |
| 6,164,441 | A * | 12/2000 | Guy et al. | B65D 75/5838 | 206/233 |
| 9,708,104 | B2 * | 7/2017 | Lyzenga et al. | B65D 75/5838 | |
| 9,969,529 | B2 * | 5/2018 | Bazbaz | B65D 75/5838 | |
| 2013/0004626 | A1 * | 1/2013 | Renders et al. | B65D 75/5838 | 493/213 |
| 2013/0320019 | A1 | 12/2013 | Tinoco et al. | | |
| 2016/0318683 | A1 | 11/2016 | Tinoco et al. | | |

FOREIGN PATENT DOCUMENTS

| | | | | | |
|---|---|---|---|---|---|
| EP | 1637472 | A1 * | 3/2006 | B65D 75/5838 | |
| EP | 1457424 | B1 * | 5/2010 | B65D 75/5838 | |
| JP | S61134959 | U * | 8/1986 | | |
| JP | 2001315799 | A * | 11/2001 | | |
| JP | 2003026224 | A * | 1/2003 | | |
| JP | 2011051597 | A * | 3/2011 | | |
| JP | 2020128228 | A * | 8/2020 | Y02W 90/10 | |
| JP | 2020183266 | A * | 11/2020 | | |
| JP | 202141965 | A | 3/2021 | | |
| KR | 20090012916 | U * | 12/2009 | B65D 75/5838 | |
| KR | 1020120125130 | A | 11/2012 | | |

* cited by examiner

PACKING MATERIAL AND PACKED PRODUCT

CROSS-REFERENCE TO RELATED APPLICATION

This application claims priority to Japanese Patent Application No. 2021-130814 filed Aug. 10, 2021, the disclosure of which is hereby incorporated by reference in its entirety.

BACKGROUND OF THE INVENTION

Field of the Invention

The present invention relates to a packing material, and a packed product formed by packing a packing object with the packing material.

Description of Related Art

Conventionally, a packing material formed of a sheet to which a cut tape is attached has been widely used as a packing material for packing food like a rice ball or a hamburger. For example, JP 2021-041965 A discloses a food packing material including: a sheet for wrapping food; and a pair of cut tapes each extending from one end to the other end in a longitudinal direction of the sheet. The packing material of JP 2021-041965 A has the pair of cut tapes formed in a wavy shape and arranged to cross each other from the one end to the other end in the longitudinal direction, and is configured to be opened by tearing the sheet along the pair of cut tapes.

However, when the pair of cut tapes are arranged in a complicated manner as in the packing material of JP 2021-041965 A, it is difficult to control an opening direction of the packing material, and there are some cases where the sheet cannot be successfully torn along the cut tapes.

SUMMARY OF THE INVENTION

Technical Problem

The present invention has been conceived in view of such circumstances, and it is an object of the present invention to provide a packing material capable of more precisely controlling its opening direction and capable of being opened easily and securely, and a packed product formed by packing a packing object with the packing material.

The following presents a simplified summary of the invention disclosed herein in order to provide a basic understanding of some aspects of the invention. This summary neither shows an extensive overview of the invention, nor is intended to delineate the scope of the invention. Its sole purpose is to present some concepts of the invention in a simplified form as a prelude to the more detailed description that is presented later.

Solution to Problem

An aspect of the present invention relates to a packing material for packing a packing object. The packing material as one embodiment includes: a sheet having an opening area that is surrounded by a cut line; and a label fixed to the opening area, in which the opening area is configured to be separable from the sheet by breaking the cut line by pulling the label in a direction in which the label is separated from the sheet.

The packing material as one embodiment can be configured such that the label includes: a label body fixed to the opening area; and a pinching part extending from the label body.

The packing material as one embodiment can be configured such that the cut line is covered by the label.

Another aspect of the present invention relates to a packed product including: a packing material; and a packing object packed by the packing material. In the packed product as one embodiment, the packing material includes: a sheet having an opening area that is surrounded by a cut line; and a label fixed to the opening area, the opening area is configured to be separable from the sheet by breaking the cut line by pulling the label in a direction in which the label is separated from the sheet, the packing object is arranged to overlap the opening area on an opposite side to a side of the sheet on which the label is arranged, and a length in a longitudinal direction of the opening area is equal to or longer than a length from one end to an other end of the packing object.

DESCRIPTION OF THE INVENTION

Figure 1:
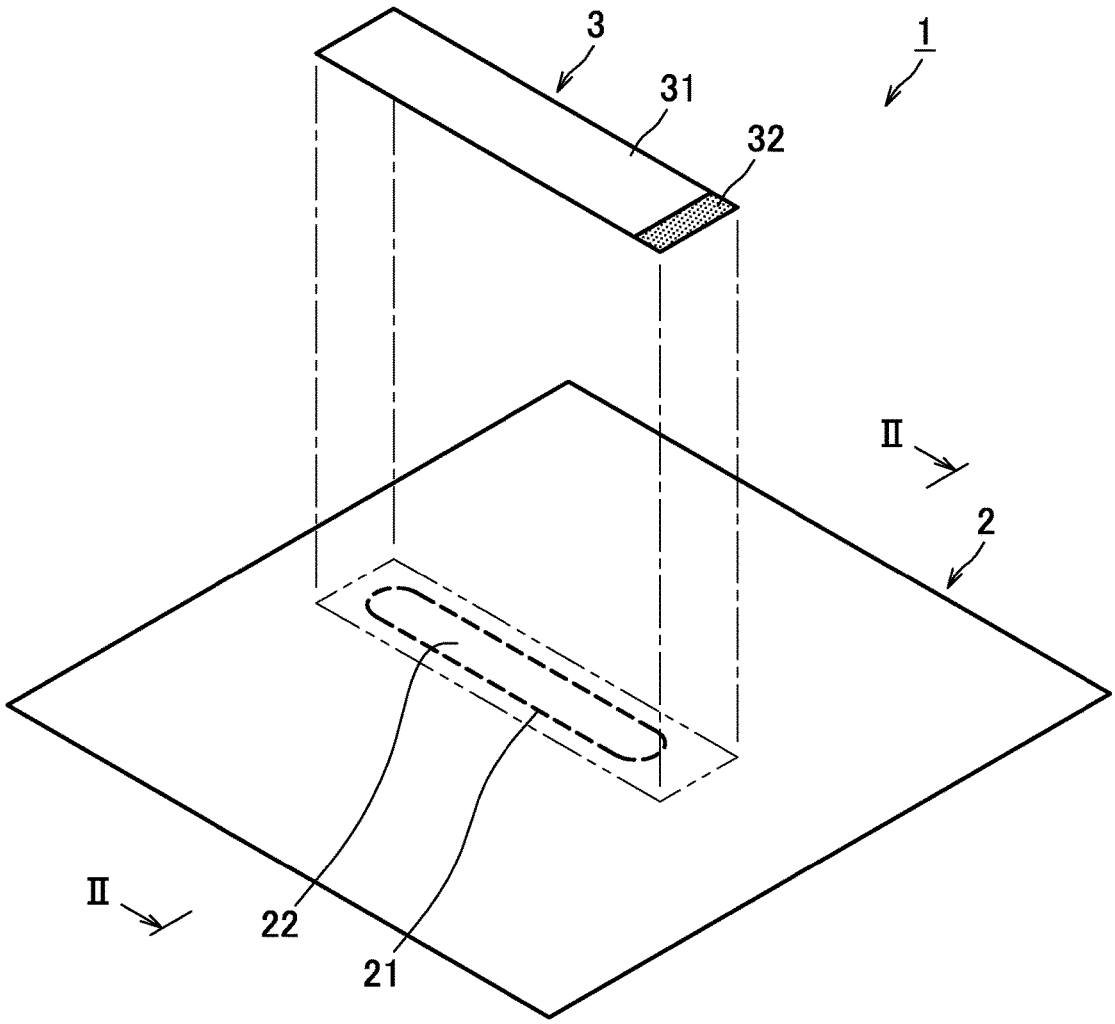
FIG. 1 is an exploded perspective view of a packing material according to a first embodiment of the present invention.

A description will be hereinafter given on a packing material 1 and a packed product 10 according to this embodiment, with reference to the drawings. In the drawings, the same or corresponding feature is denoted by the same reference sign, and the description thereon will not be repeated.

First Embodiment

<Packing Material>

Figure 2:
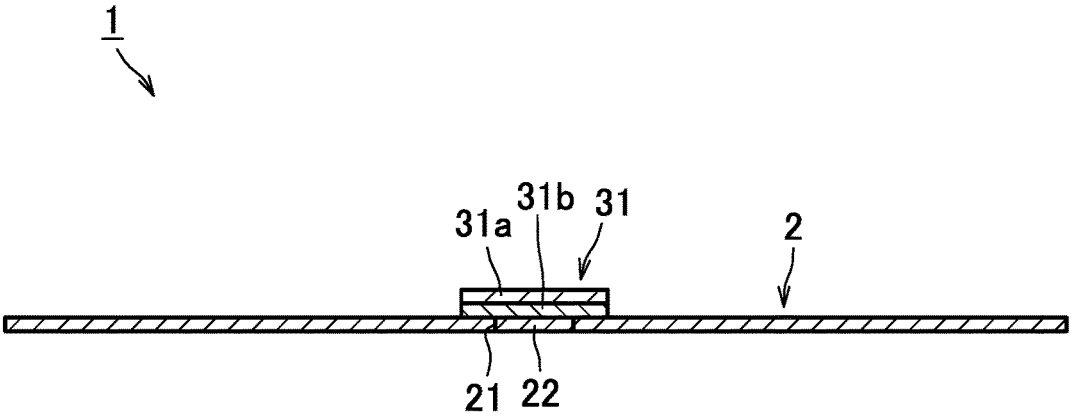
FIG. 2 is a cross-sectional view of the packing material 1 taken along line II-II in FIG. 1.

A description will be hereinafter given on the packing material 1 according to the first embodiment of the present invention. FIG. 1 is an exploded perspective view of the packing material 1 according to the first embodiment of the present invention. FIG. 2 is a cross-sectional view of the packing material 1 taken along line II-II in FIG. 1. The packing material 1 is a packing material for packing a packing object. As shown in FIG. 1, the packing material 1 includes: a sheet 2 having an opening area 22 that is surrounded by a cut line 21; and a label 3 having a label body 31 arranged to overlap the opening area 22, and a pinching part 32 extending from the label body 31. Herein, a direction corresponding to a longitudinal direction of the opening area 22 is referred to as "longitudinal direction" while a direction corresponding to a transverse direction of the opening area 22 is referred to as "transverse direction".

The sheet 2 has such a size as to be capable of packing a packing object, and is formed into a quadrangular shape in plan view. As the sheet 2, a sheet that is deformable in conformity with the shape of an object to be packed can be used, and for example, a resin sheet, paper sheet, a composite sheet formed by layering these sheets, or the like can be used. Among these, a resin sheet is preferably used as the sheet 2. When a packing object, particularly food is packed, this sheet can decrease a clearance between the packing material 1 and the food and increase integrity with the food. The sheet can also prevent damage of the packing material 1 during physical distribution.

The sheet 2 has the opening area 22 in a central portion of the sheet 2. The opening area 22 is linearly formed into a long strip shape having rounded ends in the longitudinal direction. The opening area 22 has its periphery surrounded by the cut line 21.

The opening area 22 is formed to have its length in the longitudinal direction shorter than the length in the longitudinal direction of the sheet 2. A ratio of a length L1 in the longitudinal direction of the opening area 22 to a length L2 in the longitudinal direction of the sheet 2 (L1/L2) is preferably 0.2 or more and 0.8 or less in terms of allowing a packing object to be easily taken out through the opening area 22. A ratio of a length L3 in the transverse direction of the opening area 22 (that is, the width of the opening area 22) to a length L4 in the transverse direction of the sheet 2 (L3/L4) is preferably 0.05 or more and 0.4 or less in terms of allowing a packing object to be easily taken out through the opening area 22.

The opening area 22 is fixed to the label body 31 of the label 3, which will be described later, and is configured to be separable from the sheet 2 when the label 3 is separated from the sheet 2. Specifically, the label 3 is pulled in a direction in which the label 3 is separated from the sheet 2 to break the cut line 21 so that the opening area 22 is separated from the sheet 2. When the opening area 22 is separated from the sheet 2, an opening through which a packing object can be taken out is formed in the sheet 2.

The cut line 21 is formed by perforation processing in which cuts penetrating through the sheet 2 are intermittently formed. This configuration enables the opening area 22 to be securely separated from the sheet 2 with a force of pulling the label 3 in the direction in which the label 3 is separated from the sheet 2.

The label 3 is formed into a rectangular shape, and is arranged on a front side of the sheet 2 to cover the opening area 22. Any material can be used for the label 3 as long as it can follow the sheet 2, and can be, for example, a resin film, paper, a composite material formed by layering these, or the like. The label 3 includes the label body 31 and the pinching part 32 extending from the label body 31.

The label body 31 includes a base layer 31*a*, and an adhesive layer 31*b* layered under the base layer 31*a* to contact the sheet 2. Any material can be used for the base layer 31*a*, and can be, for example, a resin film, paper, a composite material formed by layering these sheets, or the like. The adhesive layer 31*b* is formed of an adhesive. A conventionally known adhesive can be used as the adhesive without limitation.

The adhesive layer 31*b* is arranged to overlap the opening area 22. The adhesive layer 31*b* is preferably arranged to cover the entire opening area 22, which thereby allows the opening area 22 to be easily separated from the sheet 2 and thus enables the packing material 1 to be opened more easily and securely. It is preferable that the label body 31 be arranged to cover the entire cut line 21. In the case where the cut line 21 is formed by perforation processing, this configuration can prevent foreign matters from intruding through the perforations.

The pinching part 32 extends from one of the ends in the longitudinal direction of the label body 31. The pinching part 32 includes the base layer 31*a* and the adhesive layer 31*b* as in the label body 31, and is further subjected to adhesive killing process for the adhesive that forms the adhesive layer 31*b*. This enables a user to pinch the pinching part 32 without the adhesive adhering to his or her finger. Specifically, the adhesiveness of the pinching part 32 is killed by, for example, attaching a film to, applying a varnish to, or performing printing on, a portion of the pinching part 32 to which an adhesive is attached. In order to open the packing material 1, the pinching part 32 is pinched and pulled toward the end in the longitudinal direction of the label body 31 having no pinching part 32 so that the opening area 22 can be separated from the sheet 2.

<Packed Product>

Figure 3:
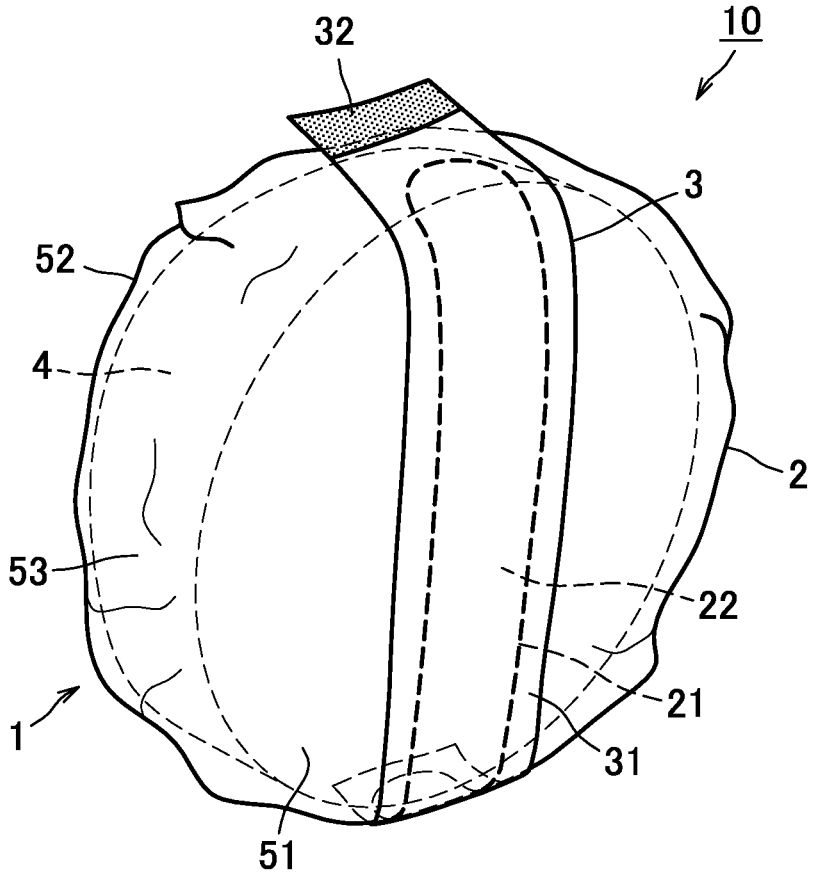
FIG. 3 is a perspective view of a packed product 10 according to the first embodiment of the present invention.

A description will be hereinafter given on the packed product 10 according to the first embodiment of the present invention. FIG. 3 is a perspective view of the packed product 10 according to the first embodiment of the present invention. As shown in FIG. 3, the packed product 10 includes the packing material 1, and a packing object 4 packed by the packing material 1. The packing material 1 includes: the sheet 2 having the opening area 22 that is surrounded by the cut line 21; and the label 3 including the label body 31 arranged to overlap the opening area 22, and the pinching part 32 extending from the label body 31. The opening area 22 is fixed to the label body 31, and is configured to be separable from the sheet 2 when the label 3 is separated from the sheet 2. The length in the longitudinal direction of the opening area 22 is equal to or longer than the length from one end to the other end of the packing object 4.

The packing object 4 is arranged to overlap the opening area 22 on an opposite side to a side of the sheet 2 on which the label 3 is arranged. Specifically, the packing object 4 is wrapped by the sheet 2 to come into contact with a back side opposite to the front side of the sheet 2 on which the label 3 is arranged, and is arranged to have its central portion overlapping a central portion of the opening area 22 when the packed product 10 is viewed from its front. Examples of the packing object 4 include food such as a rice ball, sushi, bread, a hamburger, and confectionery.

The one end and the other end of the packing object 4 are located on an outer peripheral edge of the packing material 4, and are opposed to each other about the center of the packing object 4. The configuration that the length in the longitudinal direction of the opening area 22 is equal to or longer than the length from the one end to the other end of the packing object 4 enables the packing object 4 to be easily taken out through the opening formed by separating the opening area 22 from the sheet 2.

As shown in FIG. 3, the packed product 10 includes: a front portion 51 having a circular shape as viewed from the front; a back portion 52 arranged to be opposed to the front portion 51; and a side portion 53 lying between the front portion 51 and the back portion 52 and having an annular shape as viewed from the front. The opening area 22 is arranged to cross the front portion 51, and is arranged so that both ends in an extending direction (i.e., longitudinal direction) of the opening area 22 are located on the side portion 53. The front portion 51 herein refers to an opposite side to a side with a joined portion (i.e., back portion 52) in which an outer peripheral end portion of the packing material 1 is gathered and joined together.

The packing material 1 according to the first embodiment can be suitably used for over wrapping where the packing object 4 is pushed up against the packing material 1 for packing. A description will be hereinafter given on the specific steps of the over wrapping.

First, the packing material 1 is disposed to have a side with the label 3 thereon facing upward, and is conveyed on a packing line to a position where the packing object 4 is packed. At the position where the packing object 4 is packed, a packing guide formed of a plate material with an opening slightly larger than the outer diameter of the packing object 4 is mounted to be opposed to the side of the packing material 1 on which the label 3 is disposed, and the packing object 4 is arranged under the packing material 1. When the packing material 1 reaches the position where the packing object 4 is packed, the packing object 4 located thereunder is lifted up to the packing material 1 side (that is, the packing object 4 is pushed upward) to cause the packing object 4 together with the packing material 1 to pass through the opening of the packing guide.

Next, the packing material 1 is deformed to conform to the shape of the packing object 4 to wrap the packing object 4. Specifically, the packing material 1 is deformed to conform to the shape of the packing object 4 for wrapping in the state where the packing object 4 together with the packing material 1 has passed through the hole of the packing object 4.

Finally, the outer peripheral end portion of the packing material 1 is drawn together and fixed. Specifically, the outer peripheral end portion of the packing material 1 that has been deformed is brought together, and the portion that has been brought together is fixed. A fixing method is not particularly limited, and any conventionally known fixing means, such as an adhesive tape or heat sealing can be used.

Second Embodiment

A description will be hereinafter given on portions of a packed product 10 according to a second embodiment of the present invention, the portions being different from the first embodiment, with reference to the drawings.

Figure 4:
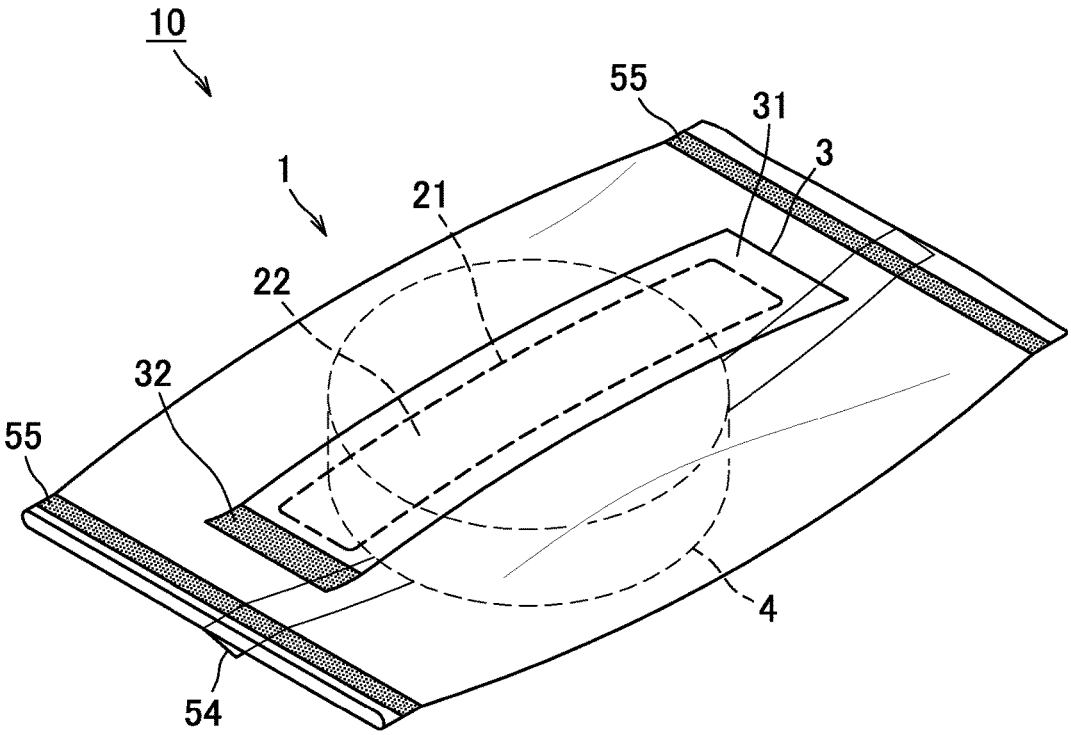
FIG. 4 is a perspective view of a packed product 10 according to a second embodiment of the present invention.

FIG. 4 is a perspective view of the packed product 10 according to the second embodiment of the present invention, and shows the packed product 10 packed by pillow packing. The packed product 10 includes a packing material 1, and a packing object 4 packed by the packing material 1. The packing material 1 includes: a sheet 2 having an opening area 22 that is surrounded by a cut line 21; and a label 3 having a label body 31 arranged to overlap the opening area 22, and a pinching part 32 extending from the label body 31. The packing material 1 according to the second embodiment is configured in the same manner as in the packing material 1 according to the first embodiment.

The packed product 10 according to the second embodiment is formed into a tubular shape with the packing material 1 being folded to wrap the packing object 4, and includes: a back lining part 54 formed by sealing both ends of the packing material 1 to each other; and a pair of sealed parts 55 respectively formed by sealing the packing material 1 at both ends in an extending direction of the back lining part 54. As shown in FIG. 4, the opening area 22 is arranged to an opposite side to a side of the packed product 10 on which the back lining part 54 is formed.

A description will be hereinafter given on the specific steps of the pillow packing using a pillow packing machine. First, a band-shaped sheet including a plurality of pieces of the packing material 1 with their ends in the longitudinal direction connected to an end in the longitudinal direction of each adjacent piece of the packing material 1 (that is, a band-shaped sheet in the state of being uncut) is placed with the surface with the labels 3 thereon facing downward, and is conveyed to a feeding position where the packing objects 4 are fed. At the feeding position where the packing objects 4 are fed, each of the feeding objects 4 is sequentially placed on each corresponding one of the plurality of pieces of the packing material 1 forming the band-shaped sheet. Thereafter, while the band-shaped sheet is being conveyed, each of the plurality of pieces of the packing material 1 is sequentially folded to form folding lines along the longitudinal direction of each piece of the packing material 1 so as to wrap each packing object 4. Then, the end portions of each folded piece of the packing material 1 that extend along the longitudinal direction are opposed to each other to be brought into contact with each other, and are sealed (heat sealed) to form the back lining part 54 extending in the longitudinal direction.

Next, in each piece of the packing material 1 wrapping the packing object 4, both ends in a direction in which the back lining part 54 extends (i.e., the longitudinal direction) are sealed along the transverse direction so as to wrap the packing object 4 to form the pair of sealed parts 55 extending in the transverse direction. Subsequently, each piece of the packing material 1 is cut off along the sealed parts 55 in the direction in which the sealed parts 55 extend (i.e., the transverse direction). With this cutting, the packed product 10 in which the packing object 4 is packed is formed.

A packing material 1 according to this embodiment includes: a sheet 2 having an opening area 22 that is surrounded by a cut line 21; and a label 3 fixed to the opening area 22, in which the opening area 22 is configured to be separable from the sheet 2 by breaking the cut line 21 by pulling the label 3 in the direction in which the label 3 is separated from the sheet 2. This configuration allows the opening area 22 to be separated from the sheet 2 when the label 3 is pulled in the direction in which the label 3 is separated from the sheet 2, and thereby enables the packing material 1 to more precisely control its opening direction. This configuration further enables a desired opening to be securely formed in the packing material 1. As a result, the packing material can be easily and securely opened.

In the packing material 1 according to this embodiment, the label 3 includes: a label body 31 fixed to the opening area 22; and a pinching part 32 extending from the label body 31. This configuration allows the user to easily open the packing material 1 by pinching the pinching part 32.

In the packing material 1 according to this embodiment, the cut line 21 is covered by the label 3. In the case where the cut line 21 is formed by perforation processing, this configuration can prevent foreign matters from intruding through the perforations.

A packed product 10 according to this embodiment includes: a packing material 1 including a sheet 2 having an opening area 22 that is surrounded by a cut line 21, and a label 3 fixed to the opening area 22, in which the opening area is configured to be separable from the sheet 2 by breaking the cut line 21 by pulling the label 3 in the direction in which the label 3 is separated from the sheet 2; and a packing object 4 packed by the packing material 1, in which the packing object 4 is arranged to overlap the opening area 22 on an opposite side to a side of the sheet 2 on which the label 3 is arranged, and a length in the longitudinal direction of the opening area 22 is equal to or longer than a length from one end to an other end of the packing object 4. This configuration allows the opening area 22 to be separated from the sheet 2 when the label 3 is pulled in the direction in which it is separated from the sheet 2, and thereby enables the packed product 10 to more precisely control the opening direction. The configuration that the length in the longitudinal direction of the opening area 22 is equal to or longer than the length from the one end to the other end of the packing object 4 enables a suitable opening for taking out the packing object 4 therethrough to be securely formed. As a result, the packed product 10 according to this embodiment enables the packing material 1 to be easily and securely opened, and enables the packing object 4 to be easily taken out.

Another Embodiments

The first embodiment and the second embodiment of the present invention are as described above, but the packing material and the packed product according to the present invention are not limited to the aforementioned embodiments, and various modifications can be made without departing from the gist of the present invention. The operational advantages of the present invention are not limited to the foregoing embodiments, either. That is, the embodiments disclosed herein should be construed in all aspects as illustrative but not limiting. The scope of the present invention is not indicated by the foregoing description but by the scope of the claims. Further, the scope of the present invention is intended to include all the modifications equivalent in the sense and the scope of the claims.

For example, the aforementioned embodiment has been described by taking, for example, the case where the sheet 2 is formed into a quadrangular shape in plan view. However, the present invention is not limited to this configuration, and can be formed into, for example, a circular shape, an oval shape, or a polygonal shape.

The aforementioned embodiment has been described by taking, for example, the case where the opening area 22 is formed into a long strip shape having rounded ends in the longitudinal direction. However, the present invention is not limited to this configuration, and the opening area 22 can be appropriately modified depending on the shape and the size of the packing object 4. For example, the opening area 22 can be an area formed into an oval shape or a rectangular shape. Further, the opening area 22 can be formed in a curved manner.

The aforementioned embodiment has been described by taking, for example, the case where the opening area 22 is surrounded by the cut line 21 across the entire periphery, without limitation thereto. For example, the opening area 22 can have a part of its periphery with no cut line 21. Such a configuration allows the opening area 22 to be left connected to the sheet without being completely cut off when the cut line 21 is broken to have the opening area 22 separated from the sheet, which enables easy disposal of the packing material after use.

The aforementioned embodiment has been described by taking, for example, the case where the cut line 21 is formed by perforation processing, without limitation thereto. The cut line 21 is not particularly limited as long as it is configured to allow the opening area 22 to be separated by a force of pulling the label 3 in the direction in which the label 3 is separated from the sheet 2. For example, the cut line 21 can be formed by microjoint processing in which broken and unbroken portions are more minutely formed than by perforation processing, or by half-cut processing in which the sheet 2 is molten by ultrasonic waves or laser beams to form a groove.

The aforementioned embodiment has been described by taking, for example, the case where the label body 31 is arranged to cover the entire opening area 22 and the base layer 31*a* has a single layered structure. However, the present invention is not limited to this configuration, and the label body 31 can be arranged to cover a part of the opening area 22. Further, the base layer 31*a* can have a laminate structure having two or more layers.

The aforementioned embodiment has been described by taking, for example, the case where the portion of the pinching part 32 to which an adhesive is attached is subjected to adhesive killing process. However, the present invention is not limited to this configuration, and for example, the pinching part 32 can be formed by extending only the base layer 31 forming the label body 31. Further, the present invention is not limited to the case where the pinching part 32 is provided, and can be, for example, configured such that the label body 31 has a portion at which a user's fingertip is hooked so that the label 3 is peeled by hooking a finger at the portion.

The aforementioned embodiment has been described by taking, for example, the case where the packing object 4 is arranged to have its central portion overlapping the central portion of the opening area 22 when the packed product 10 is viewed from the front. However, the present invention is not limited to this configuration, and the packing object 4 can be arranged to have its central portion not overlapping the central portion of the opening area 22. Specifically, the packing object 4 can be arranged such that, when the packed product 10 is viewed from the front, the central portion of the opening area 22 is displaced in the transverse direction with respect to the central portion of the packing object 4.

The aforementioned embodiment has been described by taking, for example, the case where the opening area 22 of the packed product 10 is arranged to cross the front portion 51. However, the opening area 22 can be arranged, for example, not on the front portion 51 but around the packed product 10 along the side portion 53.

The aforementioned embodiment has been described by taking, for example, the case where the back lining part 54 is formed to extend in the longitudinal direction, that is, the direction in which the back lining part 54 extends coincides with the direction in which the opening area 22 extends. However, the present invention is not limited to this configuration, and the back lining part 54 can be formed to extend in the transverse direction.

The aforementioned embodiment has been described by taking, for example, the case where the packing material 1 is used for so-called over wrapping and pillow packing. However, the present invention is not limited to this configuration, and the packing material 1 can be used for general packing bags such as flat bags or gusseted bags. The packing material 1 is folded into a tubular shape, and can be formed into a packing bag including: a back lining part 54 in which both ends of the packing material 1 are sealed together; and a sealed part 55 in which one end of the packing material 1 in the direction in which the back lining part 54 extends is sealed. That is, the packing material 1 can be formed into a pillow bag including a back lining part 54 and one sealed part 55.

REFERENCE SIGNS LIST

1: Packing material
2: Sheet
3: Label
4: Packing object
10: Packed product
21: Cut line
22: Opening area
31: Label body
32: Pinching part

What is claimed is:

1. A packed product comprising: a packing material; and a packing object packed by the packing material, wherein the packing material comprises: a sheet having an opening area that is surrounded by a cut line; and a label fixed to the opening area, the opening area is configured to be separable from the sheet by breaking the cut line by pulling the label in a direction in which the label is separated from the sheet, the packing object is arranged to overlap the opening area on an opposite side to a side of the sheet on which the label is arranged, a length in a longitudinal direction of the opening area is equal to or longer than a length from one end to an other end of the packing object, the label is arranged to cover the entire opening area, the packing material is formed into a tubular shape with the packing material being folded to wrap a packing object, and comprises: a back lining part formed by sealing both ends of the packing material to each other; and a pair of sealed parts respectively formed by sealing the packing material at both ends in an extending direction of the back lining part, and the opening area is arranged to an opposite side to a side of the packed product on which the back lining part is formed.

2. The packed product according to claim 1, wherein the label comprises: a label body fixed to the opening area; and a pinching part extending from the label body.

3. The packed product according to claim 2, wherein the cut line is covered by the label.

4. The packed product according to claim 1, wherein the cut line is covered by the label.

* * * * *